US010765276B2

(12) United States Patent
Shinagawa

(10) Patent No.: US 10,765,276 B2
(45) Date of Patent: Sep. 8, 2020

(54) HANDY-TYPE VACUUM CLEANER

(71) Applicant: TOSHIBA LIFESTYLE PRODUCTS & SERVICES CORPORATION, Kawasaki-shi (JP)

(72) Inventor: Naoko Shinagawa, Owariasahi (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 180 days.

(21) Appl. No.: 15/454,670

(22) Filed: Mar. 9, 2017

(65) Prior Publication Data

US 2017/0258282 A1 Sep. 14, 2017

(30) Foreign Application Priority Data

Mar. 14, 2016 (JP) ..... 2016-049517

(51) Int. Cl.
*A47L 5/14* (2006.01)
*A47L 5/24* (2006.01)
(Continued)

(52) U.S. Cl.
CPC *A47L 5/14* (2013.01); *A47L 5/24* (2013.01); *A47L 7/009* (2013.01); *A47L 9/08* (2013.01);
(Continued)

(58) Field of Classification Search
CPC ..... A47L 5/14; A47L 5/24; A47L 5/28; A47L 5/225; A47L 7/009; A47L 9/08; A47L 9/2842; A47L 9/28
(Continued)

(56) References Cited

U.S. PATENT DOCUMENTS 5,535,479 A * 7/1996 Pink ..... A47L 5/14 15/330
5,604,954 A * 2/1997 Webster ..... A47L 5/14 15/330
(Continued)

FOREIGN PATENT DOCUMENTS

CN 1123127 A 5/1996
CN 1976618 A 6/2007
(Continued)

OTHER PUBLICATIONS

EspaceNet Translation of JP-2005006880-A (Year: 2005).*

*Primary Examiner* — Bryan R Muller
*Assistant Examiner* — Makena S Markman
(74) *Attorney, Agent, or Firm* — Oblon, McClelland, Maier & Neustadt, L.L.P.

(57) ABSTRACT

According to one embodiment, a handy-type vacuum cleaner has a vacuum cleaner main body, a gripping part for use for gripping the vacuum cleaner main body, and a blower attachment to be attached to/detached from the vacuum cleaner main body. The vacuum cleaner main body includes an electric blower, a dust-collecting device, a main body connecting port, a suction air path, and an exhaust air path. The dust-collecting device stores the dust and dirt sucked by driving of the electric blower. The blower attachment is inserted into/extracted from the main body connecting port. The suction air path communicates between the main body connecting port and the dust-collecting device. The exhaust air path communicates with the exhaust side of the electric blower. The exhaust air path communicates with the blower attachment when the blower attachment is inserted into the main body connecting port.

10 Claims, 8 Drawing Sheets

(51) Int. Cl.

| | |
|---|---|
| ***A47L 9/24*** | (2006.01) |
| ***A47L 5/28*** | (2006.01) |
| ***A47L 9/28*** | (2006.01) |
| ***A47L 9/08*** | (2006.01) |
| ***A47L 7/00*** | (2006.01) |
| ***A47L 9/12*** | (2006.01) |
| ***A47L 9/14*** | (2006.01) |

(52) U.S. Cl.
CPC ..... *A47L 9/12* (2013.01); *A47L 9/1409* (2013.01); *A47L 9/24* (2013.01); *A47L 9/242* (2013.01); *A47L 9/248* (2013.01); *A47L 9/2842* (2013.01); *A47L 9/2857* (2013.01)

(58) Field of Classification Search
USPC ..... 15/330, 344, 312, 338
See application file for complete search history.

(56) References Cited

U.S. PATENT DOCUMENTS

| | | | | |
|---|---|---|---|---|
| 5,659,920 | A | 8/1997 | Webster et al. | |
| 6,108,863 | A * | 8/2000 | Lin | A47L 5/14 15/344 |
| 6,141,823 | A * | 11/2000 | Fujiwara | A47L 5/14 15/330 |
| 6,442,790 | B1 * | 9/2002 | Svoboda | A47L 5/14 15/330 |
| 6,735,813 | B2 * | 5/2004 | Oohama | A47L 5/14 15/327.5 |
| 10,107,292 | B2 * | 10/2018 | Schaffler | A47L 5/14 |
| 2002/0108207 | A1 | 8/2002 | Oohama | |
| 2008/0127448 | A1 * | 6/2008 | Kremsler | A47L 5/14 15/330 |
| 2008/0307602 | A1 * | 12/2008 | Andriolo | E01H 1/0809 15/330 |
| 2009/0241285 | A1 | 10/2009 | Hinklin et al. | |
| 2016/0157686 | A1 * | 6/2016 | Bermudez | A01G 20/47 15/330 |

FOREIGN PATENT DOCUMENTS

| | | | |
|---|---|---|---|
| CN | 201057998 | Y | 5/2008 |
| CN | 101205928 | A | 6/2008 |
| CN | 102438495 | A | 5/2012 |
| CN | 105380560 | A | 3/2016 |
| EP | 0 723 758 | A2 | 7/1996 |
| EP | 0 723 758 | A3 | 7/1996 |
| EP | 0 922 429 | A2 | 6/1999 |
| EP | 0 922 429 | B1 | 10/2002 |
| JP | 2001-198054 | A | 7/2001 |
| JP | 2002-238809 | A | 8/2002 |
| JP | 2004-248897 | A | 9/2004 |
| JP | 2005006880 | A * | 1/2005 |
| JP | 5636743 | | 12/2014 |
| JP | 2015-160071 | A | 9/2015 |
| WO | WO97/30620 | A1 | 8/1997 |

* cited by examiner

HANDY-TYPE VACUUM CLEANER

INCORPORATION BY REFERENCE

The present invention claims priority under 35 U.S.C. § 119 to Japanese Patent Application No. 2016-049517 filed on Mar. 14, 2016. The content of the application is incorporated herein by reference in its entirety.

FIELD

Embodiments described herein relate generally to a handy-type vacuum cleaner including a blower attachment to be attached to/detached from a vacuum cleaner main body.

BACKGROUND

There have been recently, cordless handy-type vacuum cleaners, each of which incorporates a battery such as a secondary battery as a power source part, and a user performs cleaning while gripping its gripping part and carrying the cordless handy-type vacuum cleaner. Such a handy-type vacuum cleaner which is cordless and light in weight is available not only indoors but also outdoors. Therefore, it is expected that installation of a blower function will provide a wider range of use and enhance the value of use.

In the case where a vacuum cleaner is used as a blower, in order to use exhaust air from an electric blower normally included for sucking dust and dirt, a blower attachment such as a nozzle or the like is normally connected to an exhaust port arranged on the vacuum cleaner main body housing the electric blower. However, in the case of a handy-type vacuum cleaner with such a configuration, it is concerned that a vacuum cleaner main body is enlarged in size and increased in weight, resulting in hindering original good handling of a compact and light-weight handy-type cleaner.

DETAILED DESCRIPTION

A handy-type vacuum cleaner in an embodiment has a vacuum cleaner main body, a gripping part for use for gripping the vacuum cleaner main body, and a blower attachment to be attached to/detached from the vacuum cleaner main body. The vacuum cleaner main body includes an electric blower, a dust-collecting part, a connecting port, a suction air path, and an exhaust air path. The dust-collecting part stores the dust and dirt sucked by driving of the electric blower. The blower attachment is inserted into/extracted from the connecting port. The suction air path communicates between the connecting port and the dust-collecting part. The exhaust air path communicates with the exhaust side of the electric blower. The exhaust air path communicates with the blower attachment when the blower attachment is inserted into the connecting port.

A first embodiment will be described in terms of its constitution with reference to FIG. 1 to FIG. 5.

Figure 4:
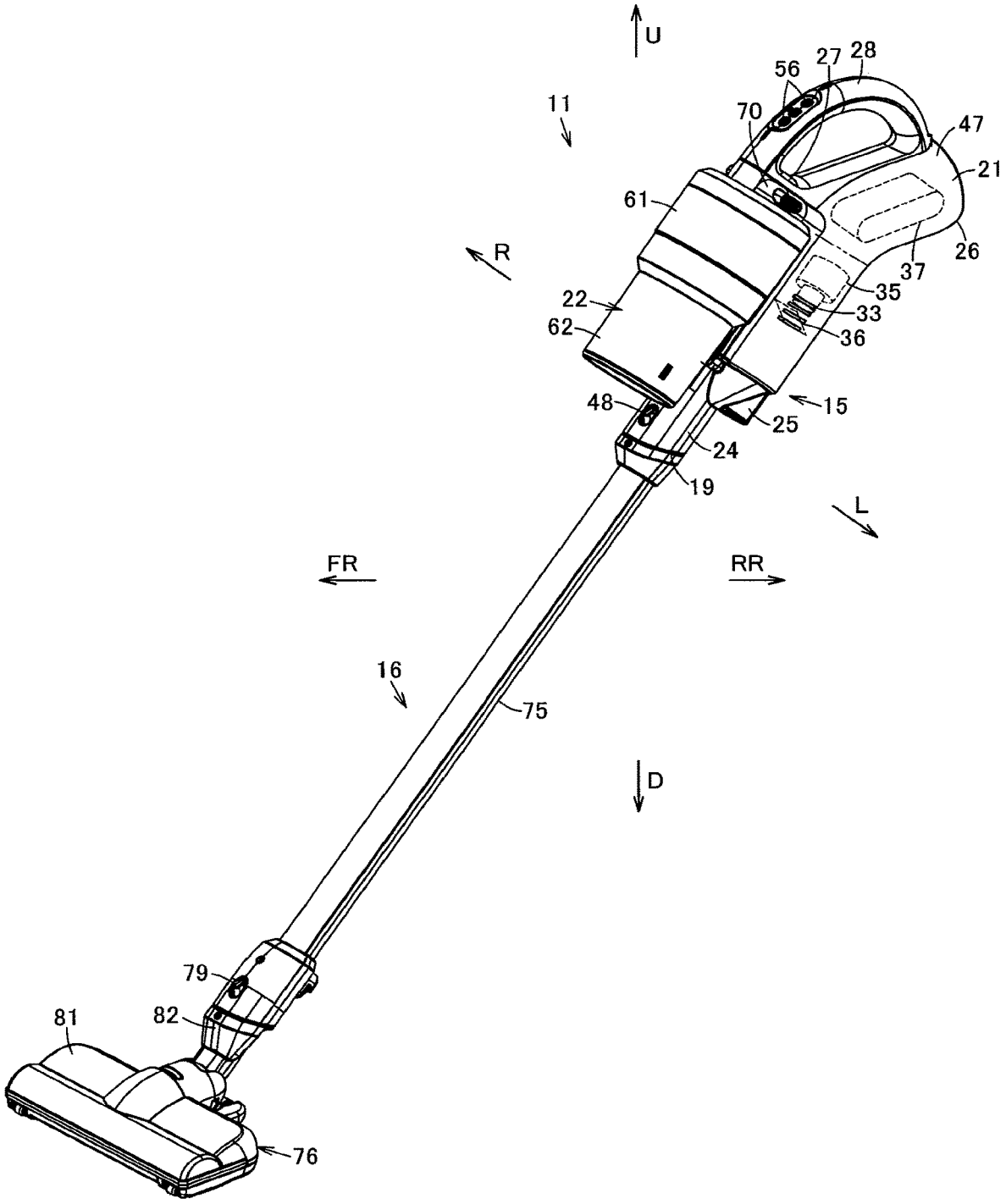
FIG. 4 is a perspective view showing a use state of the handy-type vacuum cleaner with the suction attachment attached.

In FIG. 4, reference sign 11 denotes a handy-type vacuum cleaner (hereinafter, simply referred to as a vacuum cleaner 11). A vacuum cleaning apparatus includes this vacuum cleaner 11, and a supporting apparatus (supporting stand) which supports the vacuum cleaner 11 when it is not used for cleaning (when it is stored).

Then, the vacuum cleaner 11 includes a vacuum cleaner main body 15, a suction attachment 16 (FIG. 4) which can be attached to/detached from the vacuum cleaner main body 15, and a blower attachment 17 (FIG. 5) which is selectively connected instead of the suction attachment 16. In addition, a back-and-forth direction, an up-and-down direction, a left-and-right direction and the like in terms of the vacuum cleaner 11 are based on the use state (cleaning state) in which a side of a main body connecting port 19 (which is a connecting port and described later) faces a side of a cleaning-object surface (floor surface). That is, the directions shown by an arrow U and an arrow D in FIG. 4 are defined as the up-and-down direction, the directions shown by an arrow FR and an arrow RR are defined as the back-and-forth direction, and the directions shown by an arrow L and an arrow R are defined as the left-and-right direction.

Figure 2:
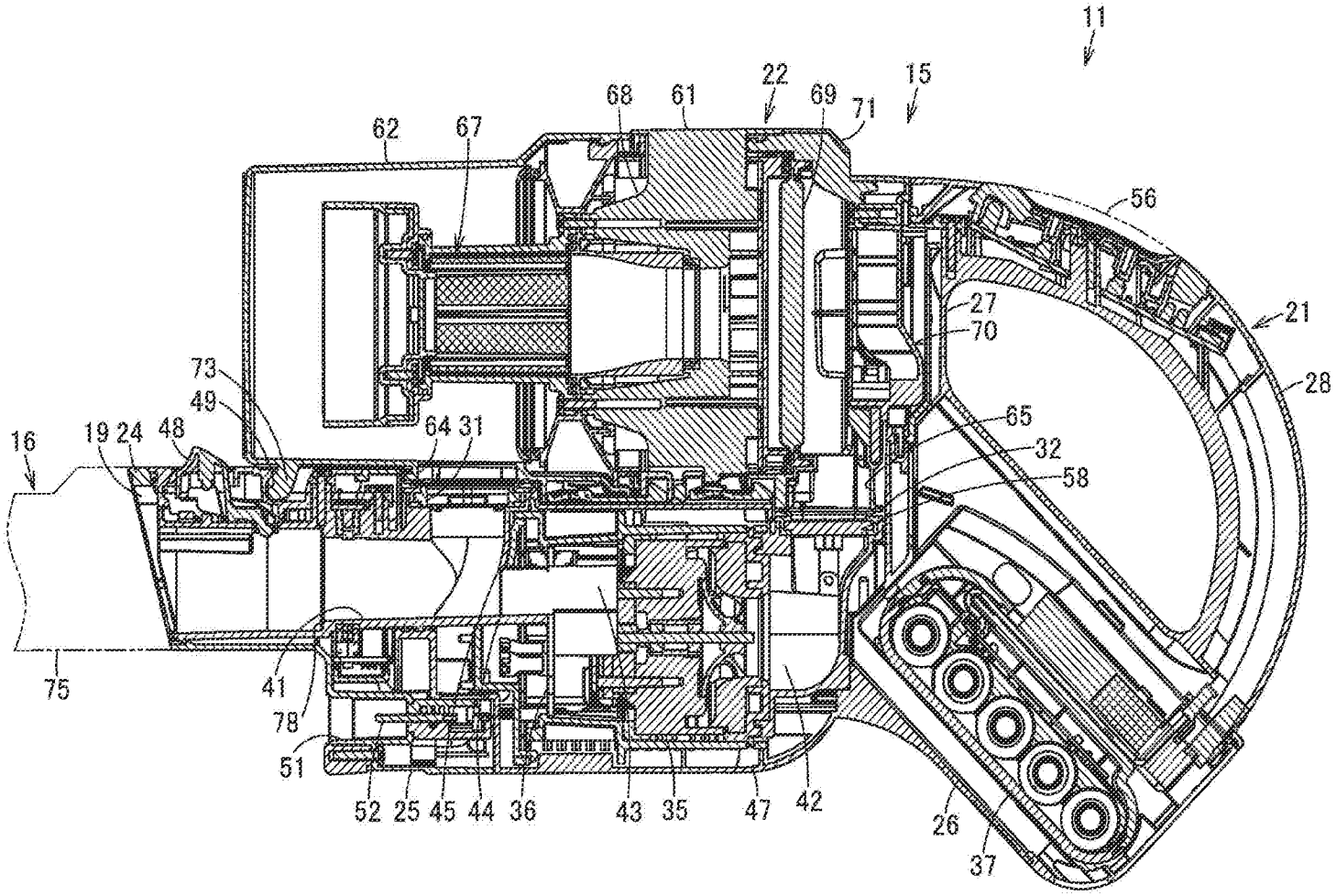
FIG. 2 is a cross sectional view showing a part of the handy-type vacuum cleaner with a suction attachment.

The vacuum cleaner main body 15 shown in FIG. 2 includes a body portion 21. Also, the vacuum cleaner main body 15 includes a dust-collecting device 22 which is a dust-collecting part. Also, the vacuum cleaner main body 15 (body portion 21) is formed in a longitudinal shape. Further, the vacuum cleaner main body 15 (body portion 21) includes a connecting part 24 arranged on the one end part thereof. The vacuum cleaner main body 15 (body portion 21) also includes a charging connecting part 25 arranged on the one end part thereof. The vacuum cleaner main body 15 (body portion 21) further includes a projecting part 26 arranged on the other end part thereof. The vacuum cleaner main body 15 (body portion 21) also includes a holding part 27 for holding the dust-collecting device 22. The vacuum cleaner main body 15 (body portion 21) also includes a gripping part 28 for use for gripping the vacuum cleaner main body 15. Further, on the vacuum cleaner main body 15 (body portion 21), on the top part facing the dust-collecting device 22, a suction communicating port 31 is opened as a first opening, while an exhaust communicating port 32 is opened as a second opening, respectively. Also, a main body exhaust port 33 (FIG. 4) is opened on each of the both sides of the vacuum cleaner main body 15 (body portion 21). Also, the inside part of the vacuum cleaner main body 15 (body portion 21) houses an electric blower 35. The vacuum cleaner main body 15 (body portion 21) also houses control means 36. The inside part of the vacuum cleaner main body 15 (body portion 21) also houses a secondary battery 37 which is a battery as a power source part. Further, the inside part of the vacuum cleaner main body 15 (body portion 21) is partitioned as a suction air path 41. The inside part of the vacuum cleaner main body 15 (body portion 21) is also partitioned as a communicating air path 42. Further, the inside part of the vacuum cleaner main body 15 (body portion 21) is partitioned as an exhaust air path 43. Then, in the vacuum cleaner main body 15 (body portion 21), an opening/closing valve 44 is disposed. In the vacuum cleaner main body 15 (body portion 21), a biaser (biasing means) 45 is also disposed.

A main casing 47 which is, for example, made of synthetic resin configures the outer shell of the body portion 21. The body portion 21 is formed in a longitudinal shape along the back-and-forth direction.

The connecting part 24 formed in a cylindrical shape projects from the front end part (lower end part) which is one end part of the body portion 21. On the front end part of the connecting part 24, the main body connecting port 19 which one of the suction attachment 16 and the blower attachment 17 (FIG. 1) is selectively inserted into/extracted from is formed. On the connecting part 24, a clamp part 48 for holding the connected suction attachment 16 or the connected blower attachment 17 (FIG. 1) is provided, and also, a supporting point part 49 which is a support point as a part to be attached when the dust-collecting device 22 is attached to the body portion 21.

The clamp part 48 which can be formed in any of well-known constitution is operably exposed on the upper part of the connecting part 24.

In the embodiment, the supporting point part 49 is recessed on the upper part of the connecting part 24 and located behind the clamp part 48, that is, on the opposite side to the main body connecting port 19.

The charging connecting part 25 for charging the secondary battery 37 is a part mechanically and electrically connected to the supporting apparatus side. The charging connecting part 25 projects from the front end part (lower end part) of the body portion 21, and a connecting recess part 51 is arranged on the tip part thereof. Inside the connecting recess part 51, a charging terminal 52 which is electrically connected to the secondary battery 37 is disposed. The charging connecting part 25 is arranged in the lower part of the connecting part 24.

The projecting part 26 is located in the rear end part (upper end part) which is the other end part of the body portion 21, and houses the secondary battery 37.

The holding part 27 projects upward from the front part of the gripping part 28 in the body portion 21. Further, on the holding part 27, a locking-and-fixing part 55 (FIG. 5) for locking and fixing the dust-collecting device 22 is provided.

The gripping part 28 is used for gripping of the vacuum cleaner main body 15 (body portion 21). The gripping part 28 which is also called a hand operating part is provided so as to connect between the projecting part 26 and the holding part 27. Also, the gripping part 28 is formed in a circular shape (in an arch shape) in the rear end part of the vacuum cleaner main body 15 (body portion 21), that is, continuously from the upper part of the projecting part 26 to the tip part (front end part) of the holding part 27. That is, the gripping part 28 is located at the top of the vacuum cleaner main body 15 (body portion 21). A setting button 56 is also disposed on the gripping part 28, which is a setting part for providing setting operation in terms of the electric blower 35 and the like to the control means 36. The setting button 56 is disposed, for example, at a position shifted forward on the gripping part 28, so as to be operable by a thumb or the like of the hand gripping the gripping part 28.

Figure 1:
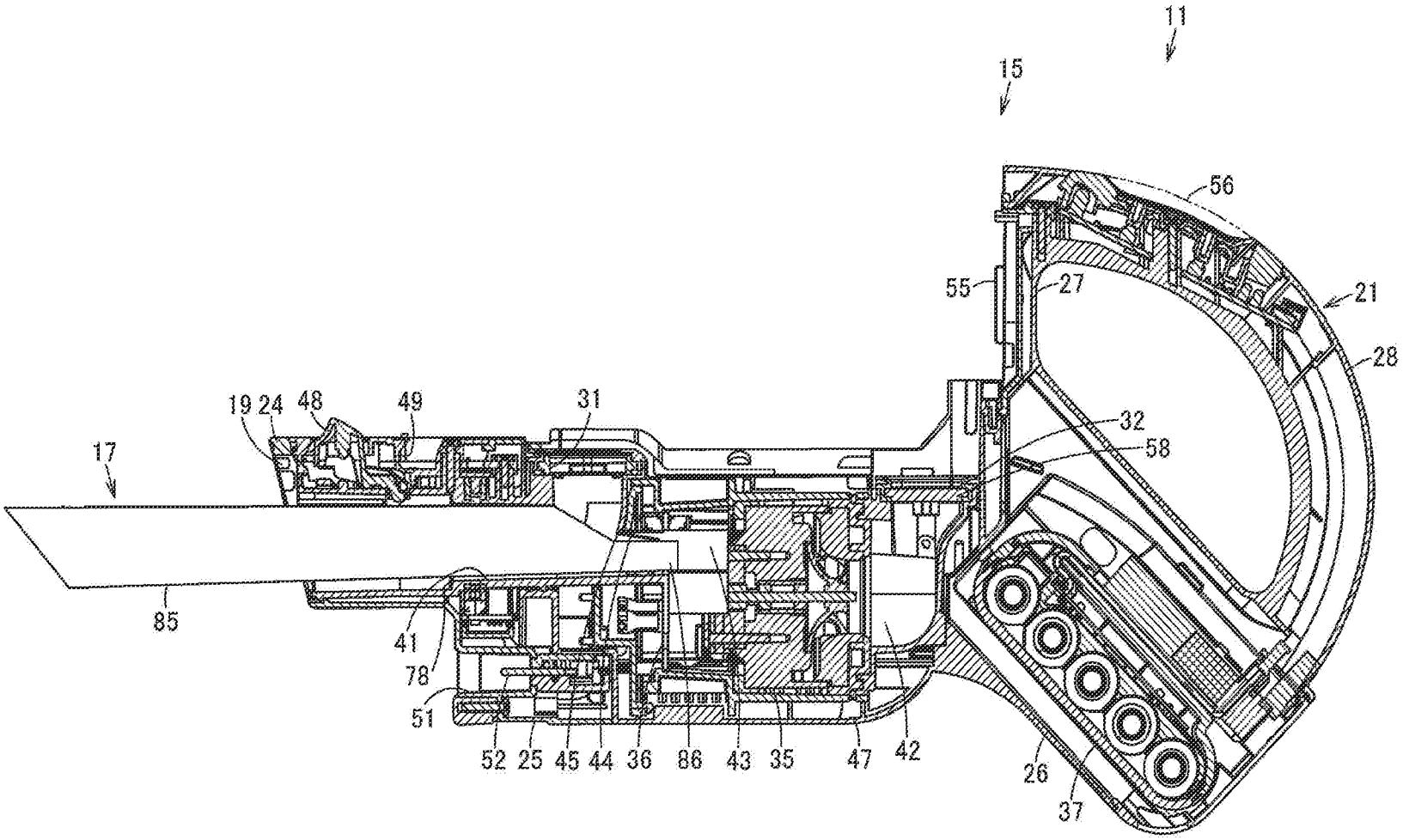
FIG. 1 is a cross sectional view showing a handy-type vacuum cleaner with a blower attachment attached in a first embodiment.

The suction communicating port 31 is disposed in the front end side of the body portion 21 (vacuum cleaner main body 15) and apart from the exhaust communicating port 32. That is, the suction communicating port 31 and the exhaust communicating port 32 are disposed apart from each other in a line along the longitudinal direction of the body portion (vacuum cleaner main body 15), and are opened along the up-and-down direction. Also, the suction communicating port 31 is located in front of the opening/closing valve 44 and the electric blower 35. Further, the suction communicating port 31 is configured, as shown in FIG. 1, so as to be closed by the blower attachment 17 inserted into the main body connecting port 19.

As shown in FIG. 2 again, a filter 58, for example, is disposed on the exhaust communicating port 32. The exhaust communicating port 32 is located behind the suction communicating port 31, that is, in the opposite side to the main body connecting port 19. The exhaust communicating port 32 is located also behind the electric blower 35.

The suction communicating port 31 and the exhaust communicating port 32 are respectively disposed so as to be exposed outside in the state where the dust-collecting device 22 is detached from the body portion 21 (vacuum cleaner main body 15).

The main body exhaust port 33 (FIG. 4) is an opening through which a part of exhaust air from the electric blower 35 is exhausted when the vacuum cleaner 11 is used as a suction cleaner.

The electric blower 35 which is a heavy article and is also called a fan motor, sucks dust-including air into the dust-collecting device 22 by generating negative pressure by driving, sucks for self-cooling the air after separation of dust and dirt by the dust-collecting device 22, and then discharges the air. The electric blower 35 formed in a cylindrical shape is disposed behind the main body connecting port 19 and the suction air path 41. The electric blower 35 is also disposed with its fan side, that is, its suction side upward (in the rear side), and its electric device side, that is, its exhaust side downward (in the front side), so as to have an axial direction along the longitudinal direction of the body portion 21 (vacuum cleaner main body 15). In the embodiment, the electric blower 35 is disposed between the suction communicating port 31 and the exhaust communicating port 32 on the body portion 21 (vacuum cleaner main body 15).

The control means 36 controls the driving of the electric blower 35. Also, the control means 36 includes a driving control part that makes the electric blower 35 and the like operate according to the setting made by a user via the setting button 56, and a charging circuit part such as a constant current circuit which receives power from the supporting apparatus side to charge the secondary battery 37. In the embodiment, a circuit board including a microcomputer as an example is used as the control means 36. The control means 36 is disposed below (in front of) the electric blower 35, that is, in the side of the main body connecting port 19 to the electric blower 35 on the body portion 21. Accordingly, the control means 36 is located in the opposite side to the secondary battery 37 in relation to the electric blower 35.

The secondary battery 37 supplies power to at least the control means 36 and the electric blower 35. The secondary battery 37 is a battery pack in which a plurality of batteries are connected in series or in parallel. The secondary battery 37 is heavier than the electric blower 35, and is further the heaviest item in the vacuum cleaner 11. The secondary battery 37 is disposed along the projecting part 26.

The suction air path 41 communicates with the suction communicating port 31 to communicate between the main body connecting port 19 and the dust-collecting device 22.

That is, the suction air path 41 communicates (directly) between the main body connecting port 19 and the suction communicating port 31 (the suction side of the dust-collecting device 22). The suction air path 41 is formed so that its upstream side is located along the longitudinal direction of the body portion 21 (vacuum cleaner main body 15) which is the opening direction of the main body connecting port 19 and its downstream side is located along the direction crossing (orthogonal to) the longitudinal direction of the body portion 21 (vacuum cleaner main body 15). Accordingly, the suction air path 41 is formed so as to be bent from the upstream side to the downstream side like in a letter L shape. Also, the suction air path 41 is disposed in front of the electric blower 35 and between the electric blower 35 and the main body connecting port 19.

The communicating air path 42 communicates with the exhaust communicating port 32 to communicate between the dust-collecting device 22 and the suction side of the electric blower 35. That is, the communicating air path 42 communicates (directly) between the exhaust communicating port 32 and the suction side of the electric blower 35. The communicating air path 42 located behind the electric blower 35 extends along the direction crossing (orthogonal to) the longitudinal direction of the body portion 21 (vacuum cleaner main body 15).

The exhaust air path 43 communicates with the exhaust side of the electric blower 35, the main body exhaust port 33 (FIG. 4) and the suction air path 41. That is, the exhaust air path 43 communicates (directly) between the main body exhaust port 33 (FIG. 4) and the exhaust side of the electric blower 35. The exhaust air path 43 is located around the electric blower 35 and behind the suction air path 41. That is, the exhaust air path 43 is disposed in the longitudinal direction of the body portion 21 (vacuum cleaner main body 15) in line with the suction air path 41. Accordingly, the exhaust air path 43 is disposed on the line extending in the insertion direction of the suction attachment 16 or the blower attachment 17 (FIG. 1) to be inserted into the main body connecting port 19. The exhaust air path 43 is located adjacent to the suction air path 41 via the opening/closing valve 44. Then, as shown in FIG. 1, the opening/closing valve 44 is opened when the blower attachment 17 is inserted into and connected to the main body connecting port 19. This brings the exhaust air path 43 into communicating with the blower attachment 17 inserted into the suction air path 41. Also, an exhaust opening not shown in figures is provided in the lower part of the exhaust air path 43. The exhaust opening directly communicates with the main body exhaust port 33 (FIG. 4). The exhaust opening is further configured to be closed by the blower attachment 17 inserted into the main body connecting port 19.

The opening/closing valve 44 opens and closes the connection between the suction air path 41 and the exhaust air path 43. The opening/closing valve 44 is operated to be opened and closed by insertion/extraction of the blower attachment 17 with respect to the main body connecting port 19. The opening/closing valve 44 having a pivotal shaft along the left-and-right direction can pivot in the back-and-forth direction, that is, in the opening direction of the main body connecting port 19, in other words, in the insertion/extraction direction of the suction attachment 16 (FIG. 2) or the blower attachment 17 with respect to the main body connecting port 19. The opening/closing valve 44 is located on the rear end part of the suction air path 41 and at the front end part of the exhaust air path 43. That is, the opening/closing valve 44 is disposed at a position behind and apart from the main body connecting port 19. In other words, the opening/closing valve 44 is disposed on the line extending in the insertion direction of the suction attachment 16 (FIG. 2) or the blower attachment 17 to be inserted into the main body connecting port 19.

The biaser 45 biases the opening/closing valve 44 in the closing direction. The biaser 45 is, for example, a torsional spring which biases the opening/closing valve 44 forward, that is, toward the direction opposite to the insertion direction of the suction attachment 16 (FIG. 2) or the blower attachment 17 to be inserted into the main body connecting port 19.

Then, the opening/closing valve 44 is configured so that, upon insertion and connection of the blower attachment 17 to the main body connecting port 19, the blower attachment 17 pushes the opening/closing valve 44 rearward against biasing of the biaser 45 to provide opening operation to make the blower attachment 17 inserted into the suction air path 41 and the exhaust air path 43 communicate with each other, while in the state where the blower attachment 17 is detached (the state where none of the suction attachment 16 (FIG. 2) and the blower attachment 17 is connected to the main body connecting port 19) or the state where as shown in FIG. 2 the suction attachment 16 is connected to the main body connecting port 19, biasing of the biaser 45 provides closing operation to block the communication between the suction air path 41 and the exhaust air path 43.

Also, the dust-collecting device 22 separates and stores the dust and dirt sucked by the driving of the electric blower 35. The dust-collecting device 22 can be attached to/detached from the body portion 21. The dust-collecting device 22 is a dust-collecting cup including a separator body 61 which separates dust and dirt from dust-including air, and a cup part 62 which is a dust container for containing the dust and dirt separated by the separator body 61. The dust-collecting device 22 has, at the positions facing the body portion 21 when being attached to the body portion 21, the openings of a suction port 64 from which dust-including air is sucked by the driving of the electric blower 35, and of an exhaust port 65 from which air having been sucked from the suction port 64 is discharged to the outside of the dust-collecting device 22 after dust and dirt is separated by the separator body 61 by the driving of the electric blower 35. Then, the dust-collecting device 22 is attached so that the suction port 64 and the exhaust port 65 face the upper side of the body portion 21, that is, being attached to the upper part of the body portion 21 with the side of the suction port 64 and the exhaust port 65 downward.

The separator body 61 is formed of, for example, synthetic resin or the like. The separator body 61 may be in any configuration. In the embodiment as an example, the separator body 61 is a multi-step centrifugal type housing a first separator part 67 which centrifuges (by cyclone separation) coarse dust being relatively large dust and dirt, a second separator part 68 which centrifuges (by cyclone separation) fine dust (ultrafine dust) being relatively small dust and dirt not having been centrifuged by the first separator part 67, and a filter body 69 which separates (by filtration and separation) dust and dirt slightly included in the air having passed through the second separator part 68. The separator body 61 is formed in a generally cylindrical shape, having a circular-arc external surface (generally cylindrical surface). Also, on the external upper part of the separator body 61, that is, on the opposite side to the cup part 62, an attaching/detaching mechanism 70 is provided so as to detachably lock the dust-collecting device 22 to the body portion 21 (holding part 27).

The first separator part 67 which is disposed coaxially with the cup part 62 and partially inserted into the cup part centrifuges dust and dirt (coarse dust) by swirling dust-including air inside the cup part 62, and compresses and stores the dust and dirt in the cup part 62. Also, the first separator part 67 further includes a lid body 71. The lid body 71 capable of locking/unlocking via lid body locking means 72 (FIG. 3) is detached, and thus the filter body 69 is exposed so as to be able to be cleaned.

A plurality of the second separator parts 68 are disposed, for example, around the upper side of the first separator part 67. Each of the separator parts 68 formed in a generally cylindrical shape having a smaller radius compared to the cup part 62 swirls the air having passed through the first separator part 67 inside so as to centrifuge dust and dirt (fine dust) and store the dust and dirt in the cup part 62.

The filter body 69 is disposed above the second separators 68 so as to face the whole exhaust sides of the second separator parts 68.

Figure 3:
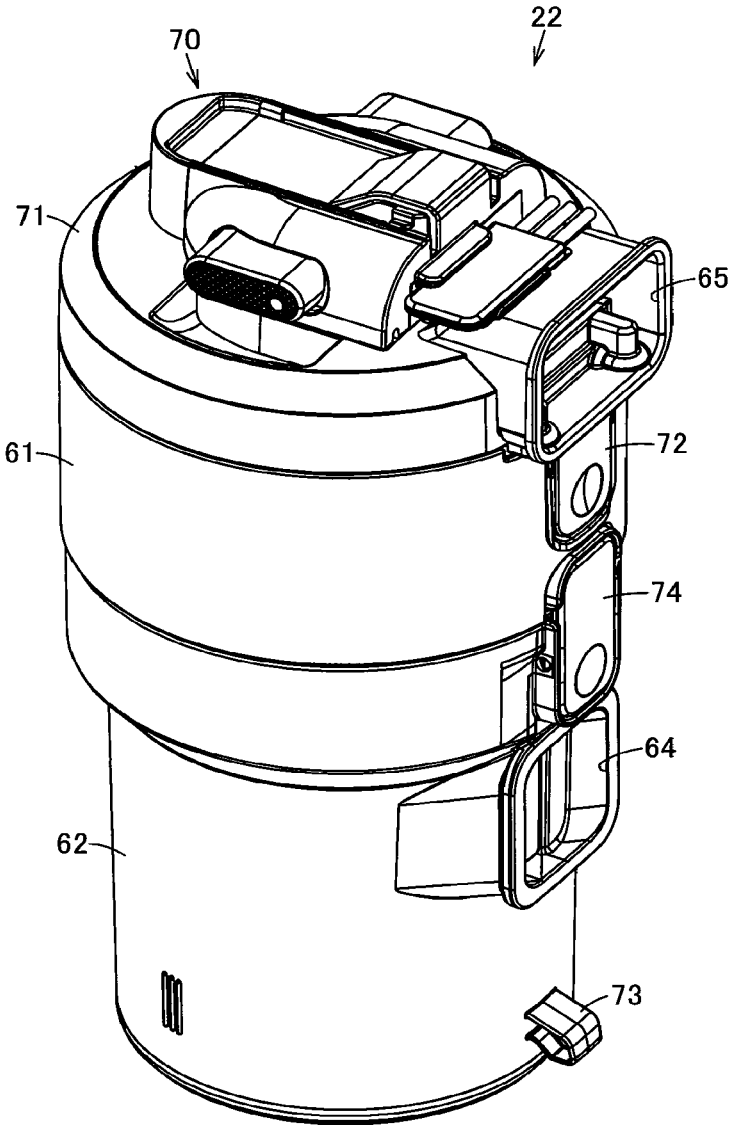
FIG. 3 is a perspective view showing a dust-collecting unit of the handy-type vacuum cleaner.

The cup part 62 formed of, for example, light transmissible synthetic resin or the like in a bottomed cylindrical shape is coaxially attachable to/detachable from the lower end part of the separator body 61. Accordingly, the external surface of the cup part 62 has a circular-arc surface (generally cylindrical surface). The cup part 62 has an opening as the above-described suction port 64 at the position facing the body portion 21, and also has a locking part 73 which is a pivot fulcrum at the time when the dust-collecting device 22 is attached to the body portion 21. Further, the cup part 62 and the separator body 61 are detachably fixed by fixing means 74 (FIG. 3).

The locking part 73 projects at a position below the suction port 64 in the opposite side to the separator body 61 on the cup part 62, that is, in the periphery of the lower end part of the cup part 62. The locking part 73 engages with the supporting point part 49 of the body portion 21. This engagement with the supporting point part 49 positions the up-and-down direction and the left-and-right direction of the dust-collecting device 22 to be attached to the body portion 21. Further, the locking part 73 is used as a rotation center at the position of the supporting point part 49 to pivot the upper side of the dust-collecting device 22 toward the body portion 21. Then, the attaching/detaching mechanism 70 is operated to lock the dust-collecting device 22 to the locking-and-fixing part 55 (FIG. 5) so that the dust-collecting device 22 is attached to the body portion 21.

The suction port 64 is airtightly connected to the suction communicating port 31 when the dust-collecting device 22 is in an attached state. Accordingly, the suction port 64 is airtightly connected to the main body connecting port 19 (via the suction communicating port 31 and the suction air path 41) when the dust-collecting device 22 is in an attached state. The suction port 64 is configured to guide dust-including air along the tangential direction of the cup part 62.

The exhaust port 65 provided, for example, on the lid body 71 is airtightly connected to the exhaust communicating port 32 when the dust-collecting device 22 is in an attached state. Accordingly, the exhaust port 65 is airtightly connected to the suction side of the electric blower 35 (via the exhaust communicating port 32 and communicating air path 42) when the dust-collecting device 22 is in an attached state. Also, the exhaust port 65 is disposed above the suction port 64 in the periphery of the upper end part of the dust-collecting device 22.

Then, the suction attachment 16 shown in FIG. 4 includes, in the embodiment, an extension pipe 75 as a suction tool and a floor brush 76 which is a suction port body as a suction tool, as an example.

The extension pipe 75 is formed in a longitudinal shape, specifically in an elongated cylindrical shape. The extension pipe 75 and the blower attachment 17 (FIG. 5) are selectively inserted into and connected to the body portion 21 (connecting part 24 (main body connecting port 19)) of the vacuum cleaner main body 15. As shown in FIG. 2, the extension pipe 75 is airtightly connected to the dust-collecting device 22 via the suction air path 41, the suction communicating port 31 and the suction port 64. Also, the base end portion of the extension pipe 75 is locked and held by the clamp part 48 in the state of being inserted into the main body connecting port 19. The base end portion is also contacted with a positioning part 78 provided inside the vacuum cleaner main body 15 (body portion 21), which positions the extension pipe 75 to the vacuum cleaner main body 15 (body portion 21). Further, as shown in FIG. 4, a floor brush clamp part 79 is provided in the tip side of the extension pipe 75 as a suction port body clamp part which detachably locks and holds the floor brush 76.

The floor brush 76 includes a casing body 81 formed in a laterally long shape, that is, a left-and-right long shape, and a connecting pipe 82 pivotally connected to the casing body 81. Then, the casing body 81 has an opening as a suction port not shown in figures on the lower part thereof facing a cleaning-object surface. Also, the connecting pipe 82 communicating with the suction port is airtightly connected to the tip side of the extension pipe 75 or the main body connecting port 19, and the connection is kept by the floor brush clamp part 79 or the clamp part 48. The base end portion of the connecting pipe 82 is locked and held by the clamp part 48 in a state of being inserted into the main body connecting port 19, in the same manner as the base end portion of the extension pipe 75. The base end portion of the connecting pipe 82 is also contacted with the positioning part 78 shown in FIG. 2 provided inside the vacuum cleaner main body 15 (body portion 21), which positions the connecting pipe 82 to the vacuum cleaner main body 15 (body portion 21).

Then, the positioning part 78 is provided in a stepwise shape inside the vacuum cleaner main body 15 (body portion 21). The positioning part 78 is disposed, for example, on the upstream end part of the suction air path 41, that is, apart from and in front of the opening/closing valve 44. The positioning part 78 is configured to position the downstream end part of the extension pipe 75 (suction attachment 16) or the connecting pipe 82 of the floor brush 76 in the upstream side, that is, in front of the opening-closing valve 44, in a state where the extension pipe 75 (suction attachment 16) or the connecting pipe 82 of the floor brush 76 is inserted into the main body connecting port 19.

The floor brush clamp part 79 which can be formed in any of well-known constitution is operably exposed on the upper part of the extension pipe 75.

The blower attachment 17 shown in FIG. 1 which is also called a blower nozzle and formed overall in a longitudinal shape, specifically in an elongated cylindrical shape, integrally includes an attachment body 85 and an insertion part 86 which is located at the end part of the attachment body 85. Then, the blower attachment 17 is formed to have a smaller outer diameter compared to the suction attachment 16 (extension pipe 75).

The attachment body 85 has an external shape (outer diameter) which fits generally with no gap in the suction air path 41 when being inserted into the main body connecting port 19. That is, the attachment body 85 has a smaller outer diameter compared to the stepwise part of the positioning part 78. The attachment body 85 is also formed to incline the tip part thereof (front end side) corresponding to the upstream side from the upper side to the lower side. Further, the attachment body 85 is inclinedly formed so that the diameter of the base end side (rear end side) corresponding to the downstream side is gradually reduced toward the insertion part 86.

The insertion part 86 is a part which operates the opening/closing valve 44 against biasing of the biaser 45. The insertion part 86 has a smaller outer diameter dimension (cross-section area of air path) compared to the attachment body 85. The insertion part 86 is provided in the base end portion of the attachment body 85. When the blower attachment 17 is inserted into and connected to the main body connecting port 19, the insertion part 86 pushes the opening/closing valve 44 rearward to provide opening operation, and thus the insertion part 86 is inserted from the suction air path 41 to the exhaust air path 43. Accordingly, the blower attachment 17 is formed so that the insertion amount into the vacuum cleaner main body 15 (main body connecting port 19) is longer compared to the suction attachment 16 (extension pipe 75 and floor brush 76 (connecting pipe 82)).

The above-described first embodiment will be described in terms of its operation with reference to FIG. 1 to FIG. 5.

When the vacuum cleaner 11 is used as a suction cleaner which sucks dust and dirt by the negative pressure generated by the driving of the electric blower 35 to catch and collect dust and dirt in the dust-collecting device 22, the suction attachment 16 as an example is connected to the vacuum cleaner main body 15. Specifically, as shown in FIG. 4, to the main body connecting port 19 of the vacuum cleaner main body 15 with the dust-collecting device 22 attached to the body portion 21, the base end side of the extension pipe 75 is inserted into and connected so as to be detachably locked and held by the clamp part 48. Further, the connecting pipe 82 of the floor brush 76 is inserted into and connected to the tip side of the extension pipe 75 so as to be detachably locked and held by the floor brush clamp part 79. In such a state, the floor brush 76 communicates with the extension pipe 75, and as shown in FIG. 2 the extension pipe 75 communicates with the dust-collecting device 22 via the main body connecting port 19, the suction air path 41 and the suction communicating port 31 of the vacuum cleaner main body 15 and via the suction port 64, and also communicates with the suction side of the electric blower 35 via the exhaust port 65 of the dust-collecting device 22 and via the exhaust communicating port 32 and the communicating air path 42 of the vacuum cleaner main body 15. In addition, as for the suction attachment 16, only of the extension pipe 75 without the floor brush 76 (FIG. 4) can be used, or the floor brush 76 (FIG. 4) (instead of the extension pipe 75) connected to the main body connecting port 19 can also be used. Further, the main body connecting port 19 in a state where the suction attachment 16 is not attached to the main body connecting port 19 is capable of sucking dust and dirt directly. In any case of these, the opening/closing valve 44 is kept in a closed state due to biasing of the biaser 45 so as to block communication between the suction air path 41 and the exhaust air path 43.

In the vacuum cleaner 11, a user gripping the gripping part 28 operates the setting button 56 to set an action, and the control means 36 makes the electric blower 35 drive according to the set action. In addition, by use of the negative pressure generated by the driving of the electric blower 35, dust and dirt on a cleaning-object surface is sucked while a user moves the floor brush 76, the tip side of the extension pipe 75, or the main body connecting port 19 with the vacuum cleaner main body 15 on the cleaning-object surface in the back-and-forth direction, the oblique direction and other directions alternately. The sucked dust-including air is sucked via the suction air path 41 and the suction communicating port 31 from the suction port 64 into the dust-collecting device 22, and almost all of dust and dirt is centrifuged by the first separator part 67 and the second separator part 68. The ultrafine dust slightly remained, if any, is caught and collected by the filter body 69. The clean air after centrifuging of dust and dirt is discharged outside the dust-collecting device 22 from the exhaust port 65, sucked via the exhaust communicating port 32 (filter 58) and the communicating air path 42 into the electric blower 35 to cool the electric blower 35, and then discharged in the air outside the vacuum cleaner main body 15 via the exhaust air path 43 and the exhaust opening from the main body exhaust port 33. When cleaning is finished, a user operates the setting button 56 to make the control means 36 stop the electric blower 35.

The dust and dirt caught and collected in the dust-collecting device 22 is disposed from the cup part 62 in such a manner that the dust-collecting device 22 is detached from the body portion 21 (vacuum cleaner main body 15) through operation of the attaching/detaching mechanism 70, and the separator body 61 is detached from the cup part 62 through operation of the fixing means 74 (FIG. 3). The lid body 71 is detached from the separator body 61 through operation of the lid body locking means 72 (FIG. 3) so that the filter body 69 is exposed to remove the dust and dirt stuck on the filter body 69. Then, the dust-collecting device 22 after disposing of dust and dirt is assembled with the separator body 61 and the cup part 62 having been put together, and again attached to the body portion 21 (vacuum cleaner main body 15) for use.

Figure 5:
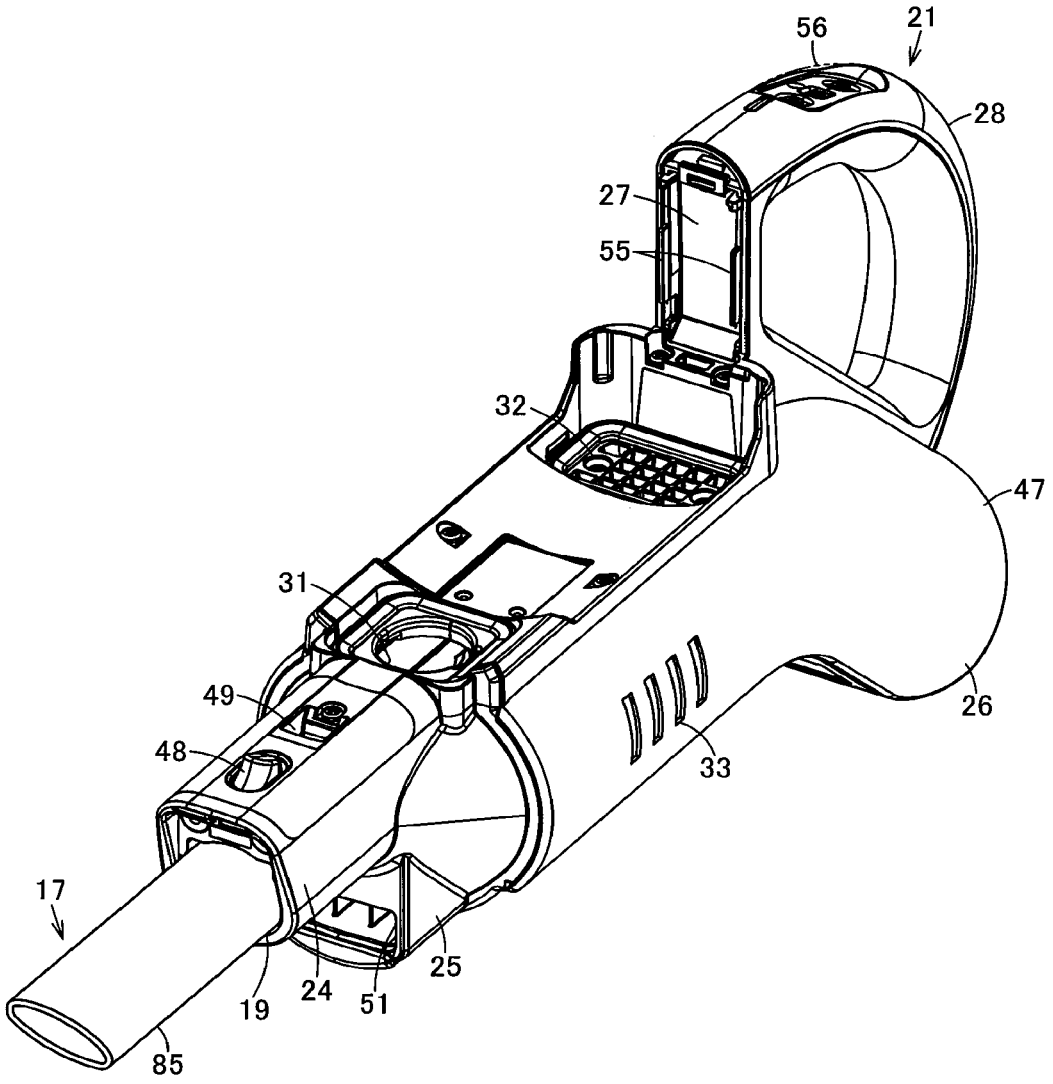
FIG. 5 is a perspective view showing the handy-type vacuum cleaner in a state where the dust-collecting part is detached from a vacuum cleaner main body thereof.

On the other hand, when the vacuum cleaner 11 is used as a blower which jets out exhaust air by the electric blower 35 to blow off dust and dirt, the dust-collecting device 22 is detached from the body portion 21 (vacuum cleaner main body 15), and further the blower attachment 17 is connected to the vacuum cleaner main body 15. Specifically, as shown in FIG. 5, the base end side of the blower attachment 17 is inserted into and connected to the main body connecting port 19 of the vacuum cleaner main body 15 in a state where the dust-collecting device 22 is detached from the body portion 21, so as to be detachably locked and held by the clamp part 48. In such a state, as shown in FIG. 1, the attachment body of the blower attachment 17 closes the suction communicating port 31 and the exhaust opening of the lower part of the exhaust air path 43. Further, the insertion part 86 pushes the opening/closing valve 44 rearward against biasing of the biaser 45, and is fitted when reaching the inside of the exhaust air path 43. Accordingly, the blower attachment 17 inserted into the suction air path 41 and the exhaust air path 43 communicate with each other. As a result, the exhaust communicating port 32 exposed due to detaching of the dust-collecting device 22 communicates with the suction side of the electric blower 35 via the communicating air path 42, and the exhaust side of the electric blower 35 communicates with the blower attachment 17 inserted into the suction air path 41 via the exhaust air path 43.

Then, in the vacuum cleaner 11, a user gripping the gripping part 28 operates the setting button 56 to set an action, and the control means 36 makes the electric blower 35 drive according to the set action to suck outside air via the exhaust communicating port 32 (filter 58) and the communicating air path 42. The sucked air is sucked into the electric blower 35 to cool the electric blower 35 and discharged, and then flows from the exhaust air path 43 to the blower attachment 17. A user grips and operates the gripping part 28, and moves the tip side of the blower attachment 17 with the vacuum cleaner main body 15 (body portion 21) for facing toward a desired position on a cleaning-object surface so as to blow off dust and dirt by the air jetted out from the blower attachment 17. When cleaning is finished, a user operates the setting button 56 to make the control means 36 stop the electric blower 35.

When cleaning is finished, the attachment 16 or the attachment 17 is detached from the vacuum cleaner 11, and the vacuum cleaner main body 15 and the attachments 16 and 17 are attached to the supporting apparatus for charging the secondary battery 37 via the charging terminal 52, as well as for storage.

As described above, in accordance with the above-described first embodiment, the exhaust air path 43 is disposed on the line extending in the insertion direction of the blower attachment 17 to be inserted into the main body connecting port 19. The opening/closing valve 44 is disposed on the line extending in the insertion direction of the blower attachment 17 to be inserted into the main body connecting port 19. The opening/closing valve 44 is operated by insertion/extraction of the blower attachment 17 to the main body connecting port 19 so that the connection of the blower attachment 17 inserted into the suction air path 41 and the exhaust air path 43 is opened/closed. This facilitates switching from the air path constitution for a suction cleaner to the air path constitution for a blower simply by connecting the blower attachment 17 to the main body connecting port 19. Accordingly, complicated switching mechanism or the like is not required and space-saving is achieved, thus suppressing enlargement in size and increase in weight of the vacuum cleaner 11.

Also, since the biaser 45 biases the opening/closing valve 44 toward the direction opposite to the insertion direction of the blower attachment 17 to be inserted into the main body connecting port 19, the biaser 45 automatically closes the opening/closing valve 44 when the blower attachment 17 is detached from the main body connecting port 19. This facilitates switching from the air path constitution for a blower to the air path constitution for a suction cleaner. Accordingly, complicated switching mechanism or the like is not required and space-saving is achieved, thus suppressing enlargement in size and increase in weight of the vacuum cleaner 11. Further, in a state of non-use where the attachment 16 or 17 is not connected to the main body connecting port 19, the opening/closing valve 44 biased in the closing direction by the biaser 45 firmly blocks the communication between the suction air path 41 and the exhaust air path 43, thus preventing dust and dirt from entering into the side of the electric blower 35 via the exhaust air path 43.

Moreover, the downstream side of the suction attachment 16 (extension pipe 75 or floor brush 76 (connecting pipe 82)) which is selectively inserted into/extracted from the main body connecting port 19 instead of the blower attachment 17 and connected to the main body connecting port 19 is located in the upstream side to the opening/closing valve 44 in the state where the suction attachment 16 is inserted into the main body connecting port 19. Accordingly, when the suction attachment 16 is connected to the main body connecting port 19, the opening/closing valve 44 is not operated and switching from the air path constitution for a suction cleaner to the air path constitution for a blower is not performed. Accordingly, even in a state where the main body connecting port 19 is commonly used for the connection with the suction attachment 16 and the connection with the blower attachment 17, and further where the above-described opening/closing valve 44 is used for switching of the air path constitution, there occurs no trouble that switching between the air path constitution for a suction cleaner and the air path constitution for a blower is performed when not desired.

Figure 6:
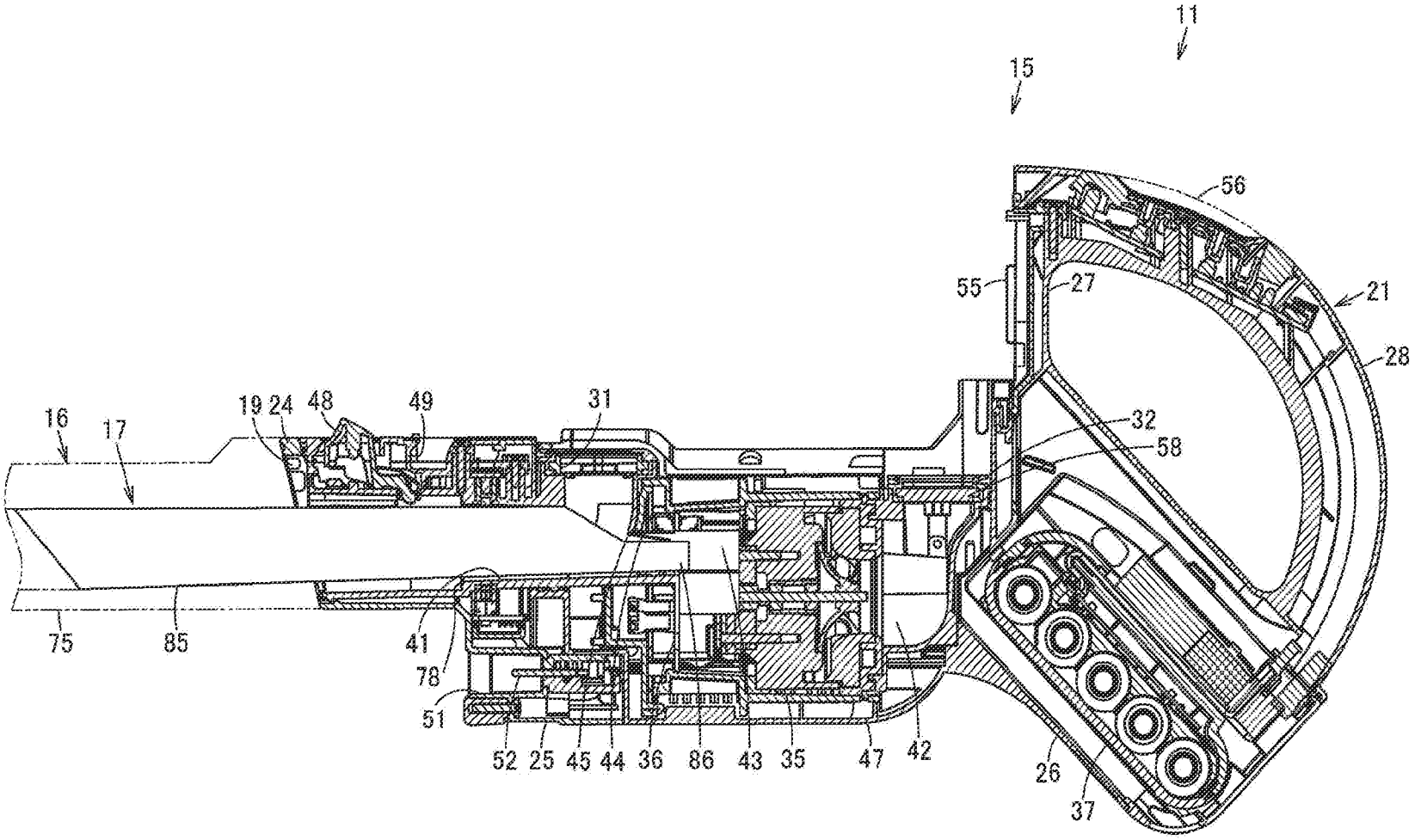
FIG. 6 is a cross sectional view showing a part of a handy-type vacuum cleaner in a second embodiment.

Next, a second embodiment will be described with reference to FIG. 6. In addition, with regard to the same constitution and action as the above-described first embodiment, the same reference sign is assigned individually and the description thereof is omitted.

In the second embodiment, the blower attachment 17 of the above-described first embodiment is formed in a thin tube shape, and in a state where the downstream side of the blower attachment 17 is inserted into and connected to the main body connecting port 19, the suction attachment 16 (the extension pipe 75 in the embodiment) can be connected to the main body connecting port 19 so as to fit and insert the upstream side of the blower attachment 17.

That is, the part projecting to the outside of the vacuum cleaner main body 15 (body portion 21) from the main body connecting port 19 which is the upstream side of the blower attachment 17 (the external shape (outer diameter dimension) of the tip side of the attachment body 85 in the embodiment) is formed to have a diameter dimension fitting the inner periphery of the base end side which is the downstream side of the extension pipe 75.

As described above, the blower attachment 17 has an external shape which, in the state where the downstream side is inserted into and connected to the main body connecting port 19, allows its upstream side to be inserted into and fitted to the suction attachment 16 (extension pipe 75) connected to the main body connecting port 19. Accordingly, even for use as a blower, the vacuum cleaner 11 can be used as is in a state where the suction attachment 16 (extension pipe 75) is connected to the main body connecting port 19 so as to cover the blower attachment 17. That is, the suction attachment 16 (extension pipe 75) can also be used for a blower. Accordingly, a suction attachment and a blower attachment are not required separately, thus preventing increase of cost for varying a blower attachment, resulting in reducing wasteful cost.

Especially, in a case of using the extension pipe 75 attached as a suction attachment for a blower, exhaust air can be jetted out to, for example, a narrow and long depth place. While in a case of using a hose body having flexibility attached as an additional suction attachment for a blower, the hose body can be bent so that the tip side alone is moved in various directions without the vacuum cleaner main body 15 (body portion 21) being turned, thus improving convenience such as being capable of jetting out exhaust air to an intricate place.

Next, a third embodiment will be described with reference to FIG. 7. In addition, with regard to the same constitution as the respective embodiments described above, the same reference sign is assigned individually and the description thereof is omitted.

In the third embodiment, the dust-collecting device 22 includes an obstructing part 91 which is a regulating part to obstruct connection of the blower attachment 17 to the main body connecting port 19 in the state where, in the respective above-described embodiments, the dust-collecting device 22 is attached to the body portion 21 (vacuum cleaner main body 15). The obstructing part 91 projects at a position of the rear part of the cup part 62 and apart from the locking part 73.

Also, on the vacuum cleaner main body 15 (body portion 21), a recess part 92 is provided, which is an inserted part into which the obstructing part 91 is inserted when the dust-collecting device 22 is attached. Further, on the bottom part of the recess part 92, a wall surface part 93 having elasticity is provided.

The recess part 92 is disposed at a position behind the positioning part 78, that is, in the downstream side to the positioning part 78. Also, the recess part 92 is opened at a position which is in front of and apart from the suction communicating port 31, and which is on the upper part of the body portion 21 facing the dust-collecting device 22.

The wall surface part 93 is a part configuring the wall surface of the suction air path 41. The wall surface part 93 is configured to be deformed and expand by the obstructing part 91 inserted into the recess part 92 so as to project toward the inside of the suction air path 41 when the dust-collecting device 22 is attached to the body portion 21 (vacuum cleaner main body 15). Accordingly, in the state where the dust-collecting device 22 is attached to the body portion 21 (vacuum cleaner main body 15), since the wall surface part 93 is pushed in so as to project toward the inside of the suction air path 41 by the obstructing part 91, the wall surface part 93 interferes with the end part of the blower attachment 17 when the blower attachment 17 is inserted into the main body connecting port 19 in the state where the dust-collecting device 22 is attached. The wall surface part 93 is configured to prevent, due to the interference, the blower attachment 17 from being inserted in further than the obstructing part 91 (wall surface part 93), in other words, to prevent the blower attachment 17 from being connected, that is, to obstruct (regulate) connection of the blower attachment 17 to the main body connecting port 19. In addition, as for the suction attachment 16 (extension pipe 75 and floor brush 76 (connecting pipe 82)), since the end part in the downstream side is inserted no further than the position of the positioning part 78, the suction attachment 16 is not interfered with the obstructing part 91 (wall surface part 93) located behind the positioning part 78.

Figure 7:
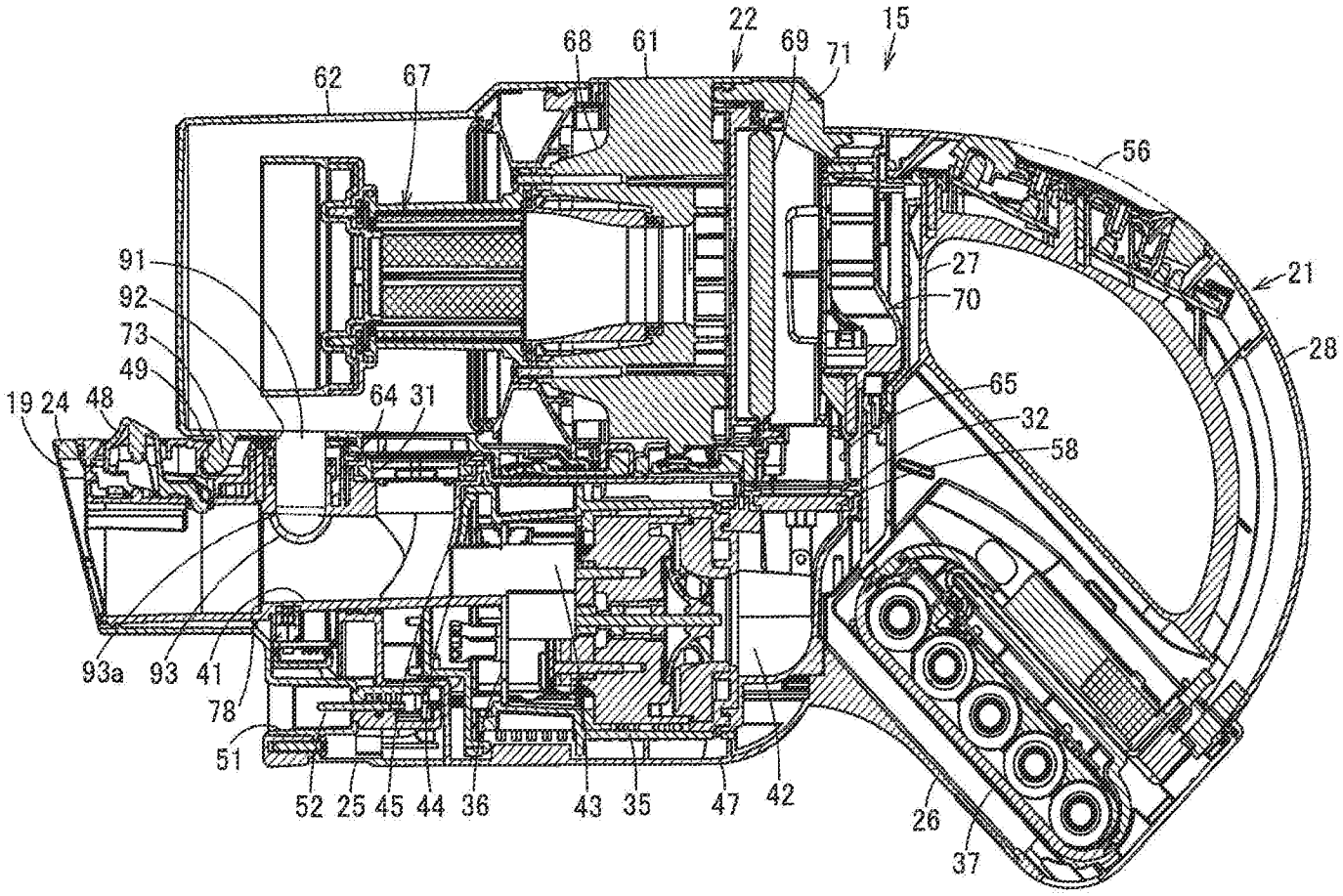
FIG. 7 is a cross sectional view showing a part of a handy-type vacuum cleaner in a third embodiment.

Also, the wall surface part 93 is further configured to shrink when the dust-collecting device 22 is detached from the body portion 21 (vacuum cleaner main body 15) and thus not to project toward the inside of the suction air path 41 (fictitious line 93*a* in FIG. 7). Accordingly, in the state where the dust-collecting device 22 is detached from the body portion 21 (vacuum cleaner main body 15), the blower attachment 17 can be inserted into and connected to the main body connecting port 19.

As described above, the obstructing part 91 is provided on the dust-collecting device 22 to prevent the blower attachment 17 from being connected to the main body connecting port 19 in the state where the dust-collecting device 22 is attached to the body portion 21 (vacuum cleaner main body 15), thereby preventing the blower attachment 17 from being connected to the main body connecting port 19 unless the dust-collecting device 22 is detached. Accordingly, a user performs operation for detaching the dust-collecting device 22 without forgetting it prior to use of the vacuum cleaner 11 as a blower. This easily and surely prevents a user from performing wrong operation such as using the blower attachment 17 in the state where the dust-collecting 22 is attached.

Also, since the obstructing part 91 does not interfere with the suction attachment 16 (the extension pipe 75 nor the floor brush 76 (the connecting pipe 82)), the vacuum cleaner 11 with the dust-collecting device 22 attached can be used normally as a suction cleaner.

Then, in accordance with at least one of the above-described embodiments, the suction communicating port 31 communicating between the suction air path 41 and the dust-collecting device 22 and the exhaust communicating port 32 communicating between the attached dust-collecting device 22 and the suction side of the electric blower 35 are provided on the vacuum cleaner main body 15 (body portion 21), wherein the suction communicating port 31 is closed by the blower attachment 17 inserted into and connected to the main body connecting port 19, and the exhaust communicating port 32 is exposed in the state where the dust-collecting device 22 is detached from the body portion 21 (vacuum cleaner main body 15). Accordingly, for use of the vacuum cleaner 11 as a blower, the blower attachment 17 is inserted into and connected to the main body connecting port 19 and the dust-collecting device 22 is detached, thereby allowing the vacuum cleaner 11 to suck air directly from the exposed exhaust communicating port 32 via the communicating air path 42 into the electric blower 35. This allows air suction into the electric blower 35 with less loss, thus allowing ensuring suction air amount while reducing load of the electric blower 35. Moreover, the weight corresponding to the dust-collecting device 22 is reduced, thus providing better handling.

In addition, since the filter 58 is disposed on the exhaust communicating port 32, when air is sucked from the exhaust communicating port 32 into the electric blower 35, dust and dirt is hardly sucked into the electric blower 35.

Figure 8:
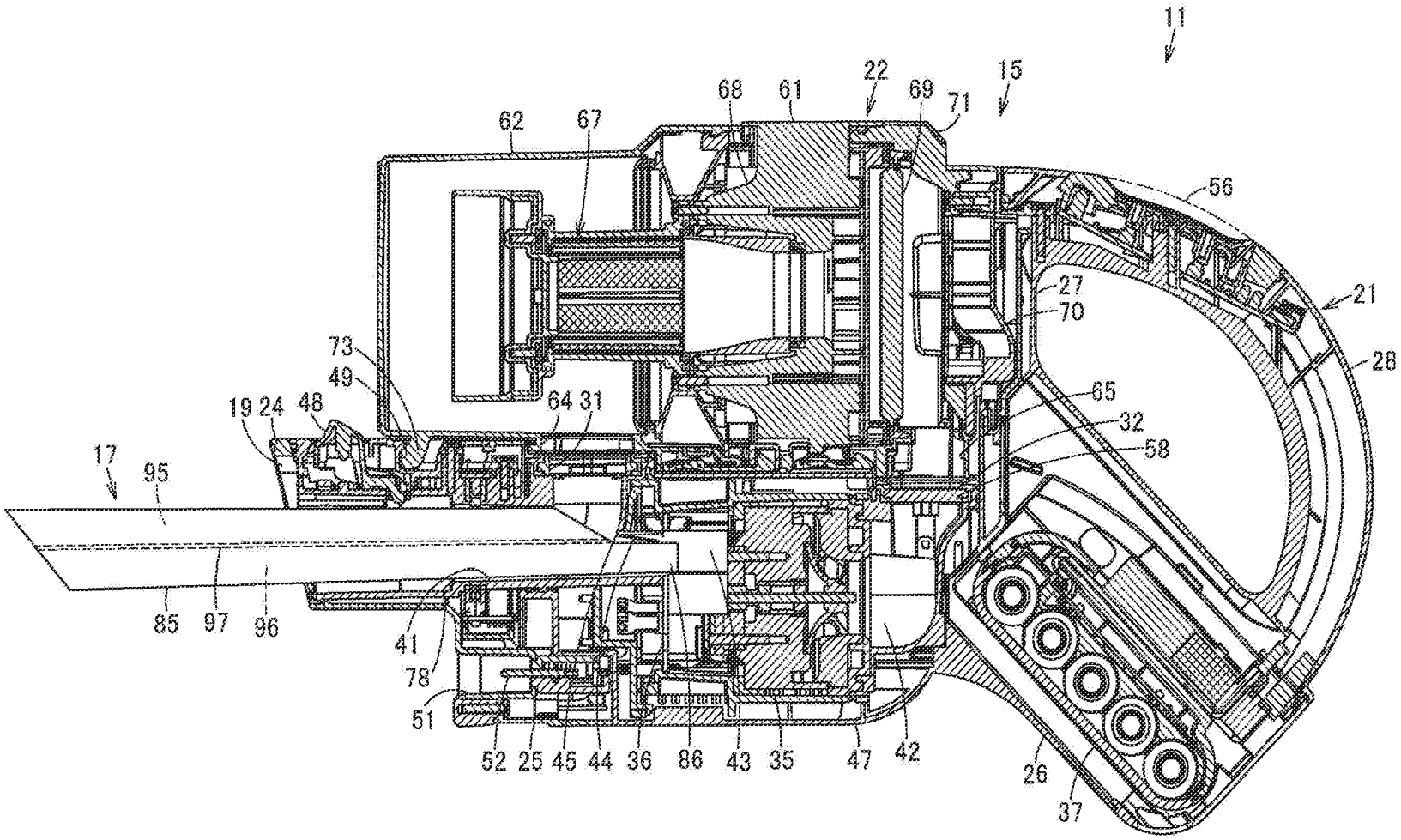
FIG. 8 is a cross sectional view showing a handy-type vacuum cleaner in a fourth embodiment.

Next, a fourth embodiment will be described with reference to FIG. 8. With regard to the same constitution and action as the respective above-described embodiments, the same reference sign is assigned individually and the description thereof is omitted.

In the fourth embodiment, the blower attachment 17 of the above-described first or second embodiment is partitioned by a partition wall 97 into two sections of a communicating section 95 communicating with the suction air path 41 and an exhausting section 96 communicating with the exhaust air path 43.

That is, the partition wall 97 is formed along the longitudinal direction in the blower attachment 17. The side above the partition wall 97 is the communicating section 95, while the side below the partition wall 97 is the exhausting section 96. In other words, the inner air path of the blower attachment 17 is divided by the partition wall 97 into an upper part and a lower part. Also, the upper part from the base end side of the blower attachment 17 which is the end part of the insertion part 86 in the embodiment is cut out and opened. Thus, the communicating section 95 of the blower attachment 17 in the state being inserted into and connected to the main body connecting port 19 communicates with the suction air path 41 via the upper part of the insertion part 86, and the exhausting section 96 communicates with the exhaust air path 43 via the end part of the insertion part 86. That is, as for the blower attachment 17 in the state being inserted into and connected to the main body connecting port 19, the communicating section 95 is connected to the upstream side of the dust-collecting device 22 via the suction air path 41, the suction communicating port 31 and the suction port 64, and the exhausting section 96 communicates with the exhaust side of the electric blower 35.

As described above, since the blower attachment 17 includes the exhausting section 96 communicating with the exhaust air path 43 in the state of being connected to the main body connecting port 19 and the communicating section 95 communicating with the suction air path 41 in the state being connected to the main body connecting port 19, the body portion 21 (vacuum cleaner main body 15) as is with the dust-collecting device 22 attached can be used as a blower simply through connection of the blower attachment 17 for switching from the air path constitution for a suction cleaner to the air path constitution for a blower. Accordingly, a user can easily switch usage of the vacuum cleaner 11 as a suction cleaner or a blower simply by switching an attachment for connection to the main body connecting port 19, resulting in improving its usability.

Also, the dust-collecting device 22 communicates with the suction side of the electric blower 35, thereby suppressing air including dust and dirt (dust-including air) from being sucked into the electric blower 35, resulting in protecting the electric blower 35 more surely.

In addition, in each of the above-described embodiments, the charging circuit part may be disposed on the supporting apparatus.

Also, as a power source part, not only the secondary battery 37 but also, for example, a cord reel device with power cord for receiving power from an external power source may be used. In this case, the supporting apparatus may not be an item for charging, and further none of the charging connecting part 25, the charging terminal 52 and the like of the vacuum cleaner 11 is required.

In accordance with at least one of the above-described embodiments, the suction air path 41 communicating between the main body connecting port 19 and the dust-collecting device 22 is provided, and the exhaust air path 43 communicating with the exhaust side of the electric blower 35 and also communicating with the blower attachment 17 inserted into the suction air path 41 when the blower attachment 17 is inserted into the main body connecting port 19 is provided, thereby allowing the main body connecting port 19 to be commonly used in the both cases of using as a suction cleaner and as a blower through connection of the blower attachment 17. Accordingly, more space can be saved than in the case of distinguishing connecting ports for a suction cleaner and for a blower, thereby allowing use as a blower while suppressing enlargement in size and increase in weight.

Also, the vacuum cleaner 11 is a cordless-type cleaner in which the secondary battery 37 supplies power to the electric blower 35, thus allowing the vacuum cleaner 11 to be carried in a wider range and resulting in enhancing the value of use.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. A handy-type vacuum cleaner, comprising:

a vacuum cleaner main body;

a gripping part for use for gripping the vacuum cleaner main body; and a blower attachment to be attached to/detached from the vacuum cleaner main body, wherein the vacuum cleaner main body includes an electric blower;

a dust-collecting part which can be attached to/detached from the vacuum cleaner main body and stores dust and dirt sucked by driving of the electric blower;

a connecting port which the blower attachment is inserted into/extracted from;

a suction air path which communicates between the connecting port and a suction port of the dust-collecting part;

a communicating air path which communicates between a communicating port, which connects to an exhaust port of the dust-collecting part, and a suction side of the electric blower;

an exhaust air path which communicates with an exhaust side of the electric blower and also communicates with the blower attachment when the blower attachment is inserted into the connecting port; and a main body exhaust port which communicates with the exhaust air path, while in a state where the blower attachment is inserted to the connecting port and the dust-collecting part is detached from the vacuum cleaner main body exposing the communicating port, outside air having been sucked into the vacuum cleaner main body at the communicating port and then passing via the communicating air path into the electric blower is discharged from the exhaust air path through the blower attachment, and while in a state where the blower attachment is not inserted to the connecting port and the dust-collecting part is attached to the vacuum cleaner main body, the suction air path is connected to the communicating air path via the dust-collecting part and air having been sucked from the connecting port flowing through the suction air path, the dust-collecting part, and the communicating air path into the electric blower is discharged from the main body exhaust port.

2. The handy-type vacuum cleaner according to claim 1, wherein the exhaust air path is disposed on a line extending in an insertion direction of the blower attachment to be inserted into the connecting port, and the vacuum cleaner main body includes an opening/closing valve which is disposed on the line extending in the insertion direction of the blower attachment to be inserted into the connecting port, and which is operated by insertion/extraction of the blower attachment with respect to the connecting port so as to open and close connection between the exhaust air path and the blower attachment.

3. The handy-type vacuum cleaner according to claim 2, further comprising:

suction tools, at least one of which is selectively inserted into/extracted from and connected to the connecting port instead of the blower attachment, and a downstream side of which is located in an upstream side to the opening/closing valve when inserted into the connecting port.

4. The handy-type vacuum cleaner according to claim 2, wherein the vacuum cleaner main body further includes a biaser which biases the opening/closing valve toward an opposite direction to the insertion direction of the blower attachment to be inserted into the connecting port.

5. The handy-type vacuum cleaner according to claim 1, wherein the vacuum cleaner main body further includes:

a first opening which is provided on the suction air path, communicates between the suction air path and the suction port of the dust-collecting part, and is closed by the blower attachment inserted into the connecting port; and a second opening which communicates between the exhaust port of the attached dust-collecting part and the communicating air path and is exposed outside of the vacuum cleaner main body when the dust-collecting part is detached.

6. The handy-type vacuum cleaner according to claim 5, wherein the dust-collecting part includes an obstructing part which obstructs connection of the blower attachment to the connecting port when the dust-collecting part is attached to the vacuum cleaner main body.

7. The handy-type vacuum cleaner according to claim 1, wherein the blower attachment includes:

an exhausting section which communicates with the exhaust air path when the blower attachment is connected to the connecting port; and a communicating section which communicates with the suction air path when the blower attachment is connected to the connecting port.

8. The handy-type vacuum cleaner according to claim 1, comprising:

a suction attachment to connect to the connecting port, wherein the blower attachment has an external shape so that, when a downstream side of the blower attachment is inserted into and connected to the connecting port, an upstream side of the blower attachment is inserted into and fitted to the suction attachment connected to the connecting port.

9. The handy-type vacuum cleaner according to claim 1, further comprising a battery which supplies power to the electric blower.

10. The handy-type vacuum cleaner of claim 1, wherein the vacuum cleaner main body further includes a suction communicating port to connect with the suction port of the dust-collecting part when the dust-collecting part is attached to the vacuum cleaner main body, the suction communicating port being different from the connecting port of the vacuum cleaner main body.

* * * * *